US011131263B2

(12) United States Patent
Hayashi

(10) Patent No.: US 11,131,263 B2
(45) Date of Patent: Sep. 28, 2021

(54) ENGINE CONTROLLER AND ENGINE CONTROL METHOD

(71) Applicant: TOYOTA JIDOSHA KABUSHIKI KAISHA, Toyota (JP)

(72) Inventor: Masatoshi Hayashi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/093,861

(22) Filed: Nov. 10, 2020

(65) Prior Publication Data

US 2021/0148296 A1 May 20, 2021

(30) Foreign Application Priority Data

Nov. 18, 2019 (JP) ..... JP2019-207793

(51) Int. Cl.
*F02D 41/14* (2006.01)
*F02D 41/18* (2006.01)
*F02D 41/02* (2006.01)

(52) U.S. Cl.
CPC ..... *F02D 41/182* (2013.01); *F02D 41/021* (2013.01); *F02D 41/1497* (2013.01); *F02D 2200/0404* (2013.01); *F02D 2200/101* (2013.01); *F02D 2200/703* (2013.01)

(58) Field of Classification Search
CPC ..... F02D 41/18; F02D 41/182; F02D 41/185; F02D 41/187; F02D 41/021; F02D 41/1497; F02D 2200/021; F02D 2200/0404; F02D 2200/0414; F02D 2200/10; F02D 2200/703; F02D 2200/101
See application file for complete search history.

(56) References Cited

U.S. PATENT DOCUMENTS 4,048,964 A * 9/1977 Kissel ..... F02D 41/185 123/482
5,012,422 A * 4/1991 Takahashi ..... F02D 41/2496 701/106
5,070,846 A * 12/1991 Dudek ..... F02D 41/1401 123/488
5,186,045 A * 2/1993 Matsuoka ..... F02D 41/187 73/114.34
5,615,657 A * 4/1997 Yoshizawa ..... F02D 41/32 123/478
6,349,592 B1 * 2/2002 Hirasawa ..... F01L 9/20 73/114.33

(Continued)

FOREIGN PATENT DOCUMENTS

JP 2001-153702 A 6/2001
JP 2010-25126 A 2/2010
JP 2018-031308 A 3/2018

*Primary Examiner* — Thomas N Moulis
(74) *Attorney, Agent, or Firm* — Oblon, McClelland, Maier & Neustadt, L.L.P.

(57) ABSTRACT

In an intake air flow rate calculation process, a pulsation correction coefficient calculation process is executed to calculate a pulsation correction coefficient, which is used to compensate for an output error of the air flow meter resulting from an intake air pulsation, based on an engine rotation speed, a throttle opening degree, and an atmospheric pressure, and the intake air flow rate is calculated by correcting the intake air flow rate with the pulsation correction coefficient.

5 Claims, 3 Drawing Sheets

(56) References Cited

U.S. PATENT DOCUMENTS

| | | | | |
|---|---|---|---|---|
| 6,366,847 | B1 * | 4/2002 | Sun | F02D 41/18 123/494 |
| 6,658,364 | B2 * | 12/2003 | Olin | F02D 41/0235 701/102 |
| 7,856,967 | B2 * | 12/2010 | Robinson | F02M 37/0082 123/677 |
| 8,676,472 | B2 * | 3/2014 | Tsukamoto | F02D 41/18 701/103 |
| 9,435,283 | B2 * | 9/2016 | Racelis | F02D 41/2474 |
| 9,810,171 | B2 * | 11/2017 | Racelis | F02D 41/222 |
| 10,578,062 | B2 * | 3/2020 | Wolgamott | F02M 35/10386 |
| 2003/0230277 | A1 * | 12/2003 | Muto | F02D 41/18 123/308 |
| 2005/0065707 | A1 * | 3/2005 | Kaga | F02D 41/182 701/103 |
| 2006/0069492 | A1 * | 3/2006 | Muto | F02D 41/18 701/103 |
| 2006/0212250 | A1 * | 9/2006 | Kobayashi | G01F 1/69 702/100 |
| 2006/0225482 | A1 * | 10/2006 | Silvis | G01F 1/36 73/1.26 |
| 2011/0004422 | A1 * | 1/2011 | Akagi | G01F 1/6965 702/46 |
| 2020/0018253 | A1 * | 1/2020 | Yamada | F02D 13/0234 |
| 2020/0200583 | A1 * | 6/2020 | Matsumoto | G01F 5/005 |
| 2020/0264023 | A1 * | 8/2020 | Kitahara | G01F 1/696 |
| 2021/0054801 | A1 * | 2/2021 | Yamada | F02D 41/222 |

* cited by examiner

ENGINE CONTROLLER AND ENGINE CONTROL METHOD

BACKGROUND

1. Field

The present disclosure relates to an engine controller and an engine control method for determining a fuel injection amount based on an intake air flow rate that is calculated from an output of an air flow meter.

2. Description of Related Art

An engine controller that controls an air-fuel ratio computes an intake air amount used for combustion in cylinders and determines a fuel injection amount based on the result of computing the intake air amount. Known methods for computing the intake air amount include a mass flow method, which is based on an output from an air flow meter that detects the intake air flow rate in an intake passage. The air flow meter is arranged upstream of a throttle valve in the intake passage. Further, in the engine, when the intake valve intermittently opens and closes, pulsation occurs in the flow of intake air in the intake passage. The pulsation affects the output error of the air flow meter, increasing the computation error of the intake air amount.

A conventionally known technique reduces the computation error of the intake air flow rate resulting from intake air pulsation. Japanese Laid-Open Patent Publication No. 2010-025126 describes an example of a technique of correcting an output of the air flow meter with a pulsation correction coefficient, which is calculated based on an engine rotation speed and a throttle opening degree, and computing the intake air amount with the corrected output of the air flow meter.

However, when correction is made using the pulsation correction coefficient calculated from the engine rotation speed and the throttle opening degree, the output error of the air flow meter resulting from the influence of the intake air pulsation may not be able to be sufficiently reduced under an environment where the atmospheric pressure is low, for example, at high altitude. Thus, under the environment where the atmospheric pressure is low, the computation error of the intake air amount resulting from the influence of the intake air pulsation may worsen the control accuracy of the fuel injection amount.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

To solve the above-described problem, a first aspect of the present disclosure provides an engine controller that calculates an intake air flow rate from an output of an air flow meter provided in a section of an intake passage upstream of a throttle valve and determines a fuel injection amount based on a calculation result of the intake air flow rate. The engine controller is configured to calculate a pulsation correction coefficient based on an engine rotation speed, a throttle opening degree, and an atmospheric pressure, the pulsation correction coefficient being used to compensate for an output error of the air flow meter, and calculate the intake air flow rate by correcting the intake air flow rate with the pulsation correction coefficient.

To solve the above-described problem, a second aspect of the present disclosure provides an engine controller that calculates an intake air flow rate from an output of an air flow meter provided in a section of an intake passage upstream of a throttle valve and determines a fuel injection amount based on a calculation result of the intake air flow rate. The engine controller comprises circuitry that is configured to calculate a pulsation correction coefficient based on an engine rotation speed, a throttle opening degree, and an atmospheric pressure and calculate the intake air flow rate by correcting the intake air flow rate with the pulsation correction coefficient. The pulsation correction coefficient is used to compensate for an output error of the air flow meter.

To solve the above-described problem, a third aspect of the present disclosure provides an engine control method for calculating an intake air flow rate from an output of an air flow meter provided in a section of an intake passage upstream of a throttle valve and determines a fuel injection amount based on a calculation result of the intake air flow rate. The method includes calculating a pulsation correction coefficient based on an engine rotation speed, a throttle opening degree, and an atmospheric pressure, the pulsation correction coefficient being used to compensate for an output error of the air flow meter, and calculating the intake air flow rate by correcting the intake air flow rate with the pulsation correction coefficient.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An engine controller 40 according to an embodiment will now be described in detail with reference to FIGS. 1 to 5.

Figure 1:
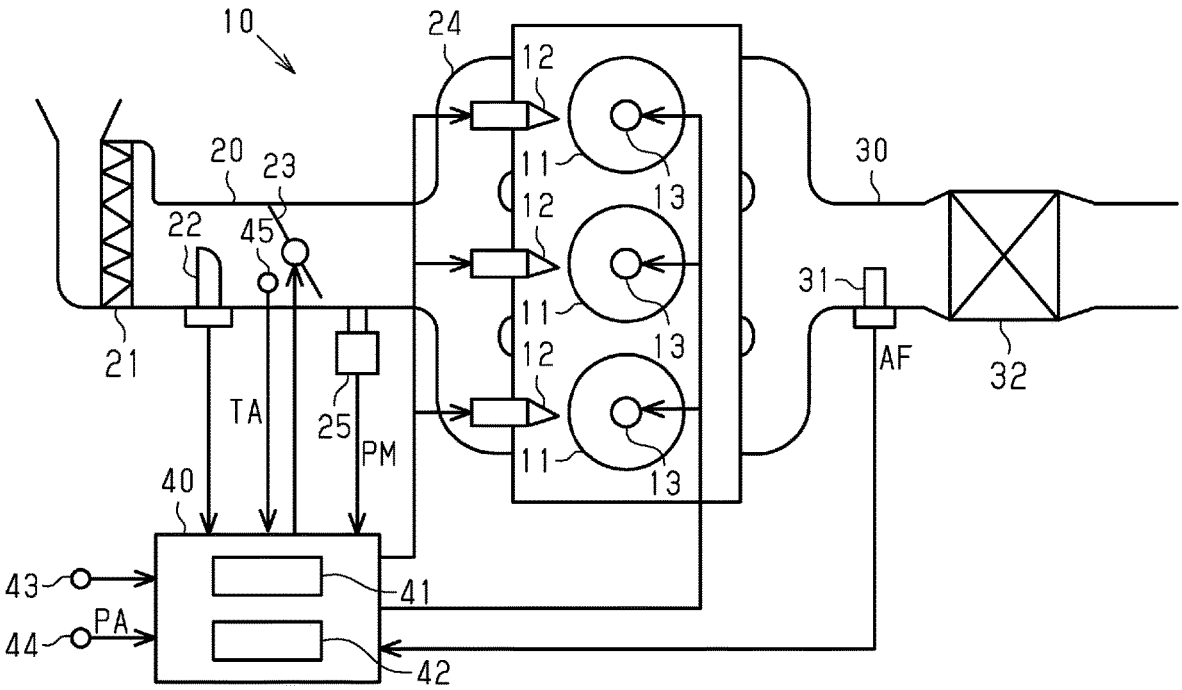
FIG. 1 is a schematic diagram showing the configuration of an engine to which a fuel injection control device according to an embodiment is applied.

As shown in FIG. 1, the engine controller 40 is applied to an engine 10, which is an inline three-cylinder, four-cycle engine. The engine 10 includes three cylinders 11, which are arranged in series. The engine 10 includes an intake passage 20, through which intake air is drawn into each cylinder 11, and an exhaust passage 30, out of which exhaust gas flowing from each cylinder 11 is discharged. Each cylinder 11 is provided with an injector 12, which injects fuel, and an ignition device 13, which ignites, with spark discharge, the air-fuel mixture drawn into the cylinder 11. The intake passage 20 is provided with an air cleaner 21, which filters out the dust and the like in intake air. The intake passage 20 is provided with an air flow meter 22 in a section downstream of the air cleaner 21 to detect an intake air flow rate. Further, the intake passage 20 is provided with a throttle valve 23 in a section downstream of the air flow meter 22 to adjust the intake air flow rate. The intake passage 20 is provided with an intake manifold 24 in a section downstream of the throttle valve 23. The intake manifold 24 is a branch tube that distributes intake air into each cylinder 11. The intake manifold 24 is provided with an intake pipe pressure sensor 25. The intake pipe pressure sensor 25 detects an intake pipe pressure PM, which is the pressure of intake air flowing in a section of the intake passage 20 downstream of the throttle valve 23. The exhaust passage 30 is provided with an air-fuel ratio sensor 31, which detects an air-fuel ratio AF of the air-fuel mixture burned in each cylinder 11. The exhaust passage 30 is provided with a three-way catalyst device 32 in a section downstream of the air-fuel ratio sensor 31. The three-way catalyst device 32 is used to purify exhaust gas.

The engine controller 40, which is applied to the engine 10, is an electronic control unit that includes a computation processor 41 and a storage device 42. The computation processor 41 executes various programs. The storage device 42 stores various programs, numerical values and arithmetic expressions used to execute the programs, and the like. The air flow meter 22, the intake pipe pressure sensor 25, and the air-fuel ratio sensor 31 are connected to the engine controller 40. Further, a crank angle sensor 43, an atmospheric pressure sensor 44, and a throttle opening degree sensor 45 are connected to the engine controller 40. The crank angle sensor 43 detects the rotation phase of a crankshaft, which is the output shaft of the engine 10. The atmospheric pressure sensor 44 detects an atmospheric pressure PA. The throttle opening degree sensor 45 detects a throttle opening degree TA, which is the opening degree of the throttle valve 23. The engine controller 40 obtains an engine rotation speed NE from the result of detecting the rotation phase of the crankshaft by the crank angle sensor 43. Based on the outputs of these sensors, the engine controller 40 executes engine control such as a fuel injection amount control for the injector 12, an ignition timing control for the ignition device 13, and an opening degree control for the throttle valve 23. The computation processor 41 executes various processes related to these engine controls by reading the programs stored in the storage device 42.

Figure 2:
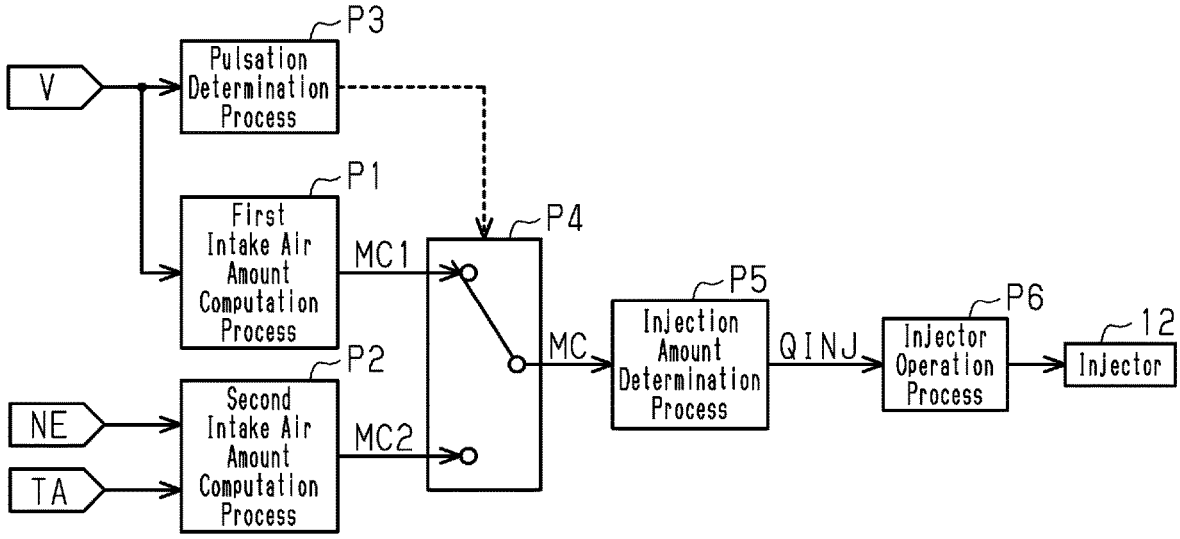
FIG. 2 is a control block diagram showing the flow of processes related to a fuel injection amount control executed by the engine controller.

The detail of the fuel injection amount control for the injector 12 will now be described with reference to FIG. 2. The engine controller 40 executes the fuel injection amount control through a first intake air amount computation process P1, a second intake air amount computation process P2, a pulsation determination process P3, a computation method switching process P4, an injection amount determination process P5, and an injector operation process P6, which are shown in FIG. 2.

In the first intake air amount computation process P1, the intake air amount used for the combustion in the cylinder 11 is computed by a mass flow method, which is based on the detected value of the intake air flow rate obtained by the air flow meter 22. In the second intake air amount computation process P2, the intake air amount used for the combustion in the cylinder 11 is computed by a throttle speed method, which is based on the throttle opening degree TA and the engine rotation speed NE. In the following description, the computed value of the intake air amount by the mass flow method in the first intake air amount computation process P1 is referred to as a first intake air amount MC1. Further, the computed value of the intake air amount by the throttle speed method in the second intake air amount computation process P2 is referred to as a second intake air amount MC2.

The pulsation determination process P3 determines whether the intake air pulsation is great. When the pulsation determination process P3 determines that the intake air pulsation is not great, the computation method switching process P4 sets the first intake air amount MC1 as the intake air amount computed value MC. When the pulsation determination process P3 determines that the intake air pulsation is great, the computation method switching process P4 sets the second intake air amount MC2 as the intake air amount computed value MC.

The injection amount determination process P5 uses the intake air amount computed value MC to determine an instructed injection amount QINJ, which is an instructed value of the fuel injection amount of the injector 12. More specifically, first, the quotient (MC/AFT) obtained by dividing the intake air amount computed value MC by a target air-fuel ratio AFT, which is the target value of the air-fuel ratio, is computed as the value of a basic injection amount QBSE. Then, the value obtained by correcting the basic injection amount QBSE through an air-fuel ratio feedback control or the like, executed by the air-fuel ratio sensor 31, based on the difference between the target air-fuel ratio AFT and the detected value of the air-fuel ratio AF is determined as the value of the instructed injection amount QINJ. The injector operation process P6 controls the driving of the injector 12 of each cylinder 11 in order to execute fuel injection with the instructed injection amount QINJ determined by the injection amount determination process P5.

The detail of the pulsation determination by the determination process P3 will now be described with reference to FIGS. 3 and 4.

Figure 3:
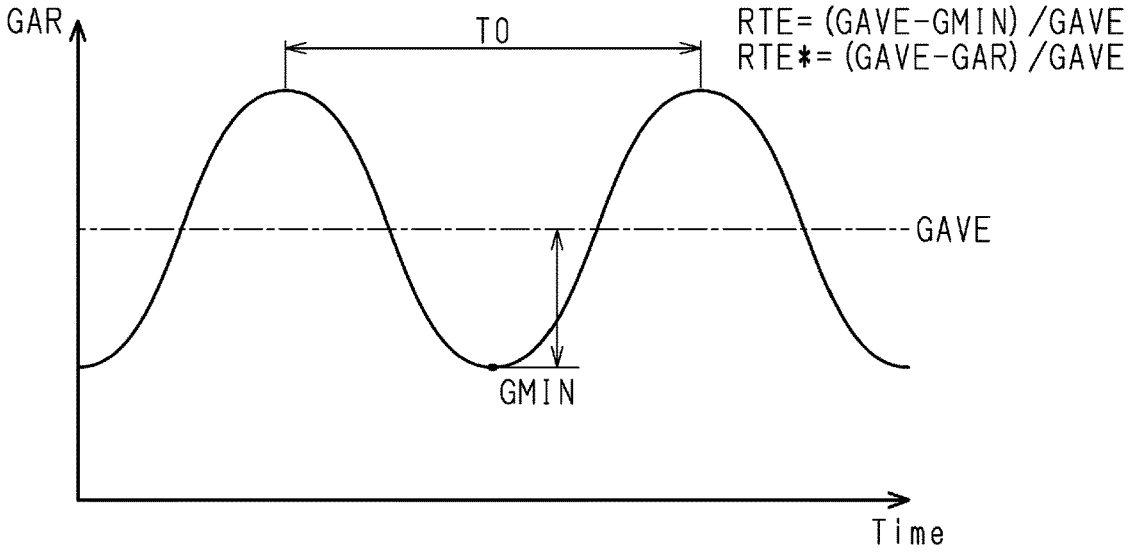
FIG. 3 is a graph illustrating a mode of computing a pulsation rate.

FIG. 3 shows the changes in an air flow meter (AFM) instantaneous flow rate GAR, which is an instantaneous value of the intake air flow rate obtained from an output of the air flow meter 22. The value of the AFM instantaneous flow rate GAR fluctuates in correspondence with the intake air pulsation. In the present embodiment, when a pulsation ratio RTE (described later) is greater than or equal to a preset great pulsation determination value $\alpha$, it is determined that the intake air pulsation is great, and then the pulsation determination is made. The pulsation ratio RTE is obtained as the quotient (GAVE−GMIN/GAVE) obtained by dividing, by an AFM average flow rate GAVE (the average value of the AFM instantaneous flow rate GAR in a single cycle of the intake air pulsation), the difference obtained by subtracting a minimum value GMIN of the AFM instantaneous flow rate GAR in a single cycle of the intake air pulsation from an AFM average flow rate GAVE. The difference refers to a bottom-side half amplitude of the AFM instantaneous flow rate GAR.

A provisional pulsation ratio RTE* is obtained as the quotient (GAVE−GAR/GAVE) obtained by dividing, by the AFM average flow rate GAVE, the value obtained by subtracting the AFM instantaneous flow rate GAR from the AFM average flow rate GAVE. When the provisional pulsation ratio RTE* is greater than or equal to the great pulsation determination value α even temporarily in a single cycle of the intake air pulsation, the pulsation ratio RTE in the cycle of the intake air pulsation is obviously greater than or equal to the great pulsation determination value α. Accordingly, in the present embodiment, at the point in time where the provisional pulsation ratio RTE* becomes greater than or equal to the great pulsation determination value α, it is determined that the intake air pulsation is great.

Figure 4:
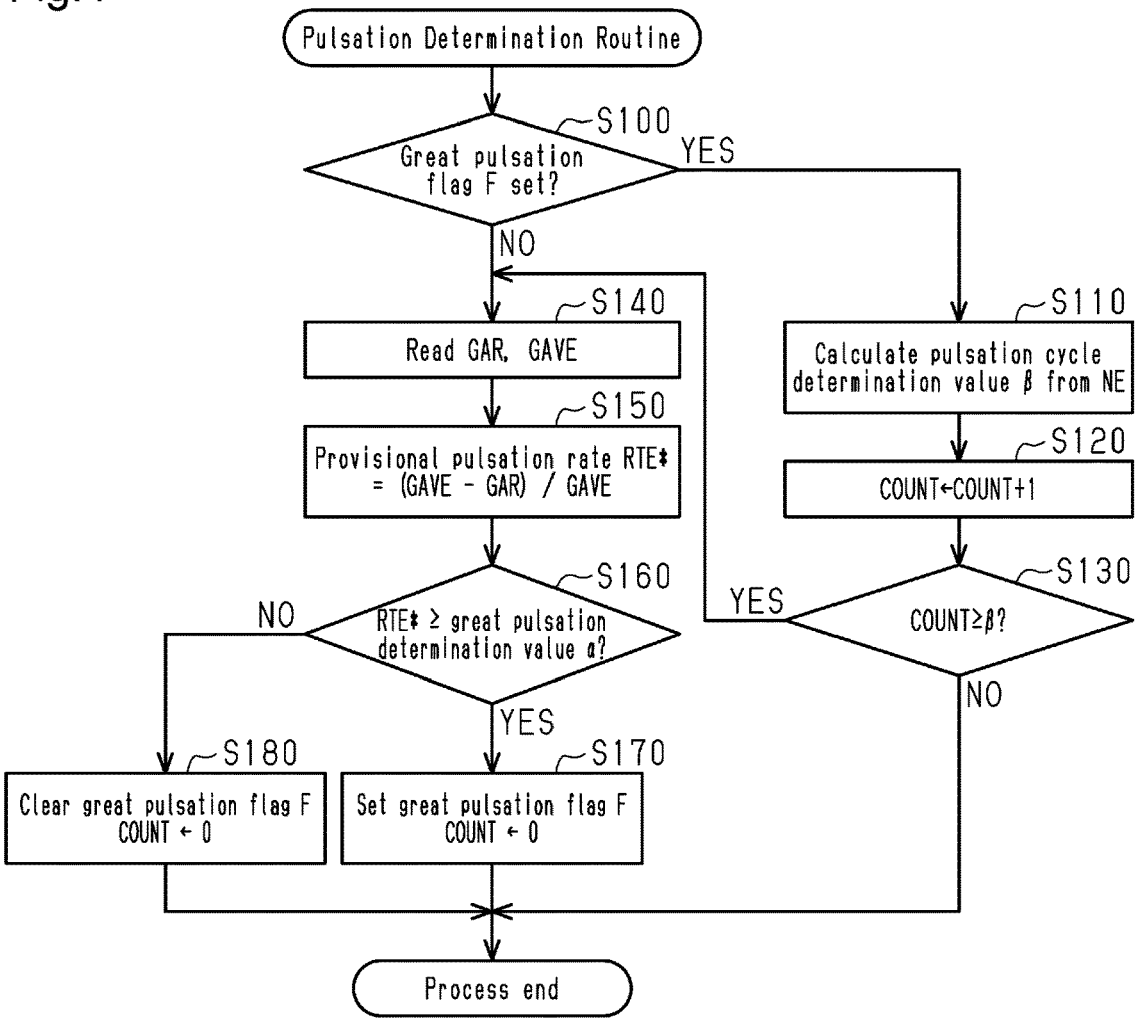
FIG. 4 is flowchart illustrating a pulsation determination routine executed by the engine controller.

FIG. 4 shows the flowchart of a pulsation determination routine executed by the engine controller 40 in the pulsation determination process P3. While the engine 10 is running, the engine controller 40 repeatedly executes the process of the current routine in a preset execution cycle T1.

In the pulsation determination, first, in step S100, it is determined whether the great pulsation flag F has been set. When the great pulsation flag F has been set, it is determined that the intake air pulsation is great. When the great pulsation flag F has been cleared, it is determined that the intake air pulsation is not great. When the great pulsation flag F has been set (step S100: YES), the process is advanced to step S110. When the great pulsation flag F has been cleared (step S100: NO), the process is advanced to step S140.

In step S110, the quotient obtained by dividing, by the execution cycle T1 of the determination process routine, cycle T0 of the intake air pulsation obtained from the engine rotation speed NE is calculated as a pulsation cycle determination value β. Subsequently, in step S120, a counter COUNT is incremented. Further, in step S130, it is determined whether the value of the incremented counter COUNT is greater than or equal to the pulsation cycle determination value β. When the value of counter COUNT is less than the pulsation cycle determination value β (step S130: NO), the process of the current routine is ended. When the value of counter COUNT is greater than or equal to the pulsation cycle determination value β (step S130: YES), the process is advanced to step S140.

In step S140, the values of the AFM instantaneous flow rate GAR and the AFM average flow rate GAVE are read. The values of the AFM instantaneous flow rate GAR and the AFM average flow rate GAVE are calculated in an intake air flow rate calculation process P10, which will be described later. Subsequently, in step S150, the quotient obtained by dividing, by the AFM average flow rate GAVE, the difference obtained by subtracting the AFM instantaneous flow rate GAR from the AFM average flow rate GAVE is calculated as the value of the provisional pulsation ratio RTE*. Then, in step S160, it is determined whether the value of the provisional pulsation ratio RTE* is greater than or equal to the great pulsation determination value α. When the value of the provisional pulsation ratio RTE* is greater than or equal to the great pulsation determination value α (step S160: YES), the process is advanced to step S170. In step S170, after the great pulsation flag F is set and the value of the counter COUNT is reset to 0, the process of the current routine is ended. When the value of the provisional pulsation ratio RTE* is less than the great pulsation determination value α (step S160: NO), the process is advanced to step S180. In step S180, after the great pulsation flag F is cleared and the value of the counter COUNT is reset to 0, the process of the current routine is ended.

In the pulsation determination routine, when the provisional pulsation ratio RTE* increases from a value less than the great pulsation determination value α to a value greater than or equal to the great pulsation determination value α, the great pulsation flag F is set. During a period until the value of counter COUNT is incremented from 0 to the pulsation cycle determination value β, the great pulsation flag F remains set. As described above, the quotient obtained by dividing cycle T0 of the intake air pulsation by the execution cycle T1 of the pulsation determination routine is set as the pulsation cycle determination value β. Further, while the great pulsation flag F is set, the counter COUNT is incremented in each execution cycle T1 of the pulsation determination routine. Accordingly, once the great pulsation flag F is set, the great pulsation flag F remains set during a period until a single cycle of the intake air pulsation passes.

Figure 5:
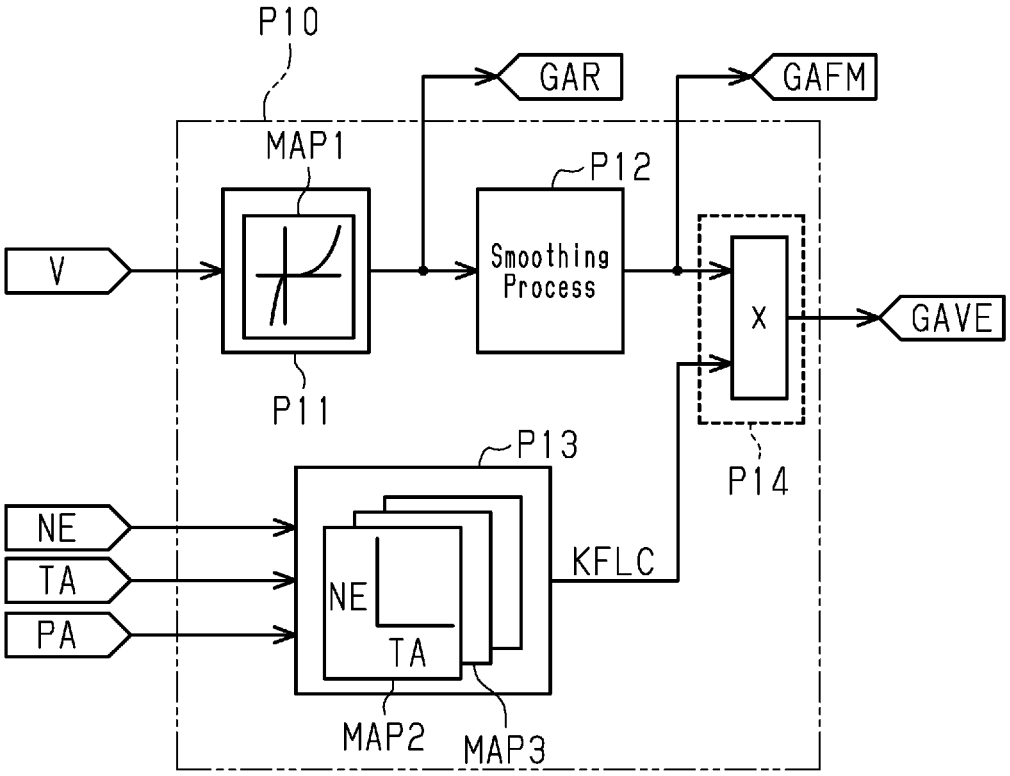
FIG. 5 is a control block diagram of the intake air flow rate calculation process executed by the engine controller.

The detail of the intake air flow rate calculation process P10 executed by the engine controller 40 in order to calculate the AFM average flow rate GAVE and the AFM instantaneous flow rate GAR will now be described with reference to FIG. 5. As shown in FIG. 5, the intake air flow rate calculation process P10 is executed through an instantaneous flow rate calculation process P11, a smoothing process P12, a pulsation correction coefficient calculation process P13, and a pulsation correction process P14.

The instantaneous flow rate calculation process P11 calculates the AFM instantaneous flow rate GAR from output V of the air flow meter 22 using an intake air flow rate conversion map MAP1, which is stored in the storage device 42 in advance. The intake air flow rate conversion map MAP1 stores the relationship of the output V of the air flow meter 22 and the intake air flow rate in a constant state in which the intake air flow rate is kept constant. Thus, the instantaneous flow rate calculation process P11 calculates the value of the AFM instantaneous flow rate GAR, which is an instantaneous value of the intake air flow rate obtained from the output V of the air flow meter 22, as a value in the constant state in which the intake air flow rate is kept constant.

Further, the smoothing process P12 calculates, as the value of a pre-pulsation correction AFM average flow rate GAFM, the value obtained by smoothing the AFM instantaneous flow rate GAR in order to average the fluctuations in the value that result from the intake air pulsation. In the present embodiment, the smoothing process P12 calculates a moving average value of the AFM instantaneous flow rate GAR as the value of the pre-pulsation correction AFM average flow rate GAFM. To compute the first intake air amount MC1 in the first intake air amount computation process P1, the pre-pulsation correction AFM average flow rate GAFM is used as a detected value of the intake air flow rate obtained by the air flow meter 22.

Furthermore, the pulsation correction coefficient calculation process P13 uses the engine rotation speed NE, the throttle opening degree TA, and the atmospheric pressure PA to compute the value of a pulsation correction coefficient KFLC. The storage device 42 of the engine controller 40 stores multiple maps MAP2, MAP3, . . . , which correspond to different atmospheric pressures PA, as the maps used to compute the pulsation correction coefficient KFLC based on the engine rotation speed NE and the throttle opening degree TA. Each of the maps MAP2, MAP3, . . . stores the relationship of the engine rotation speed NE and the throttle opening degree TA in the corresponding atmospheric pressure PA obtained in advance with a correction coefficient necessary for compensating for the error of the pre-pulsation correction AFM average flow rate GAFM. The pulsation correction coefficient calculation process P13 selects a map corresponding to the current atmospheric pressure PA and calculates, as the value of the pulsation correction coefficient KFLC, the value of the correction coefficient corresponding to the current engine rotation speed NE and throttle opening degree TA in the selected map.

Additionally, the pulsation correction process P14 calculates, as the value of the AFM average flow rate GAVE, the product obtained by multiplying the pulsation correction coefficient KFLC by the pre-pulsation correction AFM average flow rate GAFM (GAVE=GAFM×KFLC). As described above, the value of the AFM average flow rate GAVE calculated by the pulsation correction process P14 is used for the pulsation determination process P3 together with the AFM instantaneous flow rate GAR calculated by the above-described instantaneous flow rate calculation process P11.

The operation and advantages of the present embodiment will now be described.

While the engine 10 is running, an intermittent flow of intake air into each cylinder 11 generates pulsation in the flow of intake air in the intake passage 20. When the intake air pulsation is great at the section of the intake passage 20 where the air flow meter 22 is provided, the output error of the air flow meter 22 is great. This increases the detection error of the intake air flow rate detected based on an output of the air flow meter 22. In the engine controller 40, the first intake air amount computation process P1 computes the intake air amount used for the combustion in the cylinders 11 by the mass flow method, which is based on the detected value of the intake air flow rate obtained by the air flow meter 22. Additionally, the second intake air amount computation process P2 computes the intake air amount used for the combustion in the cylinders 11 by the throttle speed method, which is based on the throttle opening degree TA and the engine rotation speed NE, without using the detected value of the intake air flow rate of the air flow meter 22. When the intake air pulsation is not great, the mass flow method computes the intake air amount more accurately than the throttle speed method. Thus, the first intake air amount MC1, which is computed by the first intake air amount computation process P1, is more accurate than the second intake air amount MC2, which is computed by the second intake air amount computation process P2. When the intake air pulsation is greater than a certain degree, the second intake air amount MC2, which is computed by the throttle speed method, indicates a more accurate value than the first intake air amount MC1. This is because the throttle speed method is unaffected by a decrease in the detection accuracy of the air flow meter 22 that results from the intake air pulsation. Thus, in the engine controller 40, the pulsation determination process P3 determines whether the intake air pulsation is great. When it is determined that the intake air pulsation is not great, the first intake air amount MC1, which is computed by the first intake air amount computation process Pt, is set as the intake air amount computed value MC. When it is determined that the intake air pulsation is great, the second intake air amount MC2, which is computed by the second intake air amount computation process P2, is set as the intake air amount computed value MC. This limits a decrease in the computation accuracy of the intake air amount resulting from the influence of the intake air pulsation. Accordingly, a decrease in the accuracy of controlling the fuel injection amount executed based on the computation result of the intake air amount is limited.

In the engine controller 40, the intake air flow rate calculation process P10 calculates the pre-pulsation correction AFM average flow rate GAFM as a smoothed value of the AFM instantaneous flow rate GAR obtained from an output of the air flow meter 22. When the intake air pulsation is small and the output error of the air flow meter 22 is small, the value of the pre-pulsation correction AFM average flow rate GAFM is close to the average value of an actual intake air flow rate. However, when the intake air pulsation is great and the output error of the air flow meter 22 is great, the value of the pre-pulsation correction AFM average flow rate GAFM is deviated from the average value of an actual intake air flow rate. As described above, only when the intake air pulsation is not great, the computed value of the first intake air amount MC1 in the first intake air amount computation process P1 is reflected on the control of the fuel injection amount. Thus, even if the pre-pulsation correction AFM average flow rate GAFM is directly used to compute the first intake air amount MC1, the control accuracy of the fuel injection amount is unaffected. In contrast, the pulsation determination in the pulsation determination process P3 needs to be executed even when the intake air pulsation is great. The direct use of the pre-pulsation correction AFM average flow rate GAFM for the determination may lower the determination accuracy.

As described above, the intake air pulsation in the air flow meter 22 is generated when the intake air pulsation generated by an intermittent flow of intake air into each cylinder 11 of the engine 10 returns upstream to the air flow meter 22 through the throttle valve 23. The cycle of the intake air pulsation prior to returning upstream is defined by the cycle of the intake stroke and determined by the engine rotation speed NE. When the throttle opening degree TA is small, the throttle valve 23 functions as a barrier that prevents the intake air pulsation from returning upstream to the air flow meter 22. In addition, the output error of the air flow meter 22 resulting from the intake air pulsation is changed by a cycle of the intake air pulsation. Accordingly, making correction with the pulsation correction coefficient obtained from the engine rotation speed NE and the throttle opening degree TA compensates for the error of the pre-pulsation correction AFM average flow rate GAFM resulting from the intake air pulsation.

Under an environment where the atmospheric pressure is low, for example, at high altitude, as compared with under a normal-pressure environment, for example, at low altitude, the intake air flow rate in the intake passage 20 is small even if the engine rotation speed NE and the throttle opening degree TA are the same. In such a manner, the atmospheric pressure PA changes the intake air flow rate in the intake passage 20. Thus, the atmospheric pressure PA also changes the relationship of the intake air pulsation with the engine rotation speed NE and the throttle opening degree TA. In the present embodiment, the pulsation correction coefficient KFLC is calculated based on the engine rotation speed NE, the throttle opening degree TA, and the atmospheric pressure PA, and the value obtained by correcting the pre-pulsation correction AFM average flow rate GAFM with the pulsation correction coefficient KFLC is calculated as the value of the AFM average flow rate GAVE used for the pulsation determination. Accordingly, the AFM average flow rate GAVE is calculated as a value on which the influence of the atmospheric pressure PA on the output error of the air flow meter 22 is reflected.

The engine controller 40 of the present embodiment has the following advantages.

(1) When the intake air pulsation is not great, the first intake air amount MC1 computed by the mass flow method is set as the intake air amount computed value MC used to determine the fuel injection amount. When the intake air pulsation is great, the second intake air amount MC2 computed by the throttle speed method is set as the intake air amount computed value MC used to determine the fuel injection amount. This limits a decrease in the computation accuracy of the intake air amount resulting from the influence of the intake air pulsation and thus limits a decrease in the control accuracy of the fuel injection amount.

(2) The output error of the air flow meter 22 resulting from the intake air pulsation in the intake passage 20 is also affected by the atmospheric pressure PA. With the influence of the atmospheric pressure PA reflected, the engine controller 40 calculates the pulsation correction coefficient KFLC to compensate for an amount corresponding to the output error of the air flow meter 22 resulting from the intake air pulsation. Thus, even under an environment where the atmospheric pressure is low, a decrease in the calculation accuracy of the intake air flow rate resulting from the influence of the intake air pulsation is limited. Consequently, a decrease in the control accuracy of the fuel injection amount resulting from the intake air pulsation is limited.

In the present embodiment, the pulsation correction coefficient KFLC is calculated based on the engine rotation speed NE, the throttle opening degree TA, and the atmospheric pressure PA. Further, the value obtained by correcting the pre-pulsation correction AFM average flow rate GAFM, which has been obtained from an output of the air flow meter 22, with the pulsation correction coefficient KFLC is calculated as the value of the AFM average flow rate GAVE used for the pulsation determination. Accordingly, to calculate the AFM average flow rate GAVE, an amount corresponding to the error resulting from the influence of the intake air pulsation is compensated for with the influence of the atmospheric pressure PA on the intake air pulsation reflected. As a result, the accuracy of the pulsation determination improves.

The present embodiment may be modified as follows. The present embodiment and the following modifications can be combined as long as the combined modifications remain technically consistent with each other.

In the above-described embodiment, the computation of the second intake air amount MC2 in the second intake air amount computation process P2 is executed by the throttle speed method. Instead, the second intake air amount computation process P2 may be calculated by a speed density method, which is based on the intake pipe pressure PM. In this case, switching the method for computing the intake air amount from the mass flow method to the speed density method limits a decrease in the computation accuracy of the intake air amount resulting from the influence of the intake air pulsation. Thus, a decrease in the control accuracy of the fuel injection amount is limited.

In the present embodiment, the method for computing the intake air amount is switched to the mass flow method and to the throttle speed method or the speed density method depending on the result of the pulsation determination. Instead, the intake air amount may be constantly computed by the mass flow method regardless of the magnitude of the intake air pulsation. In this case, when the computation of the first intake air amount MC1 in the first intake air amount computation process P1 is executed using the AFM average flow rate GAVE calculated by the intake air flow rate calculation process P10, the intake air amount is computed accurately with the influence of the atmospheric pressure PA on the output error of the air flow meter 22 reflected. In this case, the second intake air amount computation process P2, the pulsation determination process P3, and the computation method switching process P4 are omitted.

In the above-described embodiment, in the smoothing process P12, the moving average value of the AFM instantaneous flow rate GAR is calculated as a smoothed value of the AFM instantaneous flow rate GAR. Instead, the smoothed value of the AFM instantaneous flow rate GAR may be calculated using other methods such as single averaging.

In the above-described embodiment, correction is made using the pulsation correction coefficient KFLC to calculate the AFM average flow rate GAVE. Instead, correction may be made using the pulsation correction coefficient KFLC to calculate the AFM instantaneous flow rate GAR.

In the above-described embodiment, the pulsation correction coefficient calculation process P13 calculates the pulsation correction coefficient KFLC using the multiple maps MAP2, MAP3, . . . , which correspond to different atmospheric pressures PA. Instead, the pulsation correction coefficient KFLC may be calculated in other modes, for example, using a single computation map based on the engine rotation speed NE, the throttle opening degree TA, and the atmospheric pressure PA.

The engine controller 40 is not limited to one that executes software processing on all processes executed by itself. For example, the engine controller 40 may include at least part of the processes executed by the software in the present embodiment as one that is executed by hardware circuits dedicated to execution of these processes (such as ASIC). That is, the engine controller 40 simply needs to have any one of the following configurations (a) to (c): (a) a configuration including a processor that executes all of the above-described processes according to programs and a program storage device such as a ROM that stores the programs; (b) a configuration including a processor and a program storage device that execute part of the above-described processes according to the programs and a dedicated hardware circuit that executes the remaining processes; and (c) a configuration including a dedicated hardware circuit that executes all of the above-described processes. A plurality of software processing circuits each including a processor and a program storage device and a plurality of dedicated hardware circuits may be provided. That is, the above-described processes may be executed in any manner as long as the processes are executed by processing circuitry that includes at least one of one or more software processing circuits and one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. An engine controller that calculates an intake air flow rate from an output of an air flow meter provided in a section of an intake passage upstream of a throttle valve and determines a fuel injection amount based on a calculation result of the intake air flow rate, wherein the engine controller is configured to:

calculate a pulsation correction coefficient based on an engine rotation speed, a throttle opening degree, and an atmospheric pressure, the pulsation correction coefficient being used to compensate for an output error of the air flow meter; and calculate the intake air flow rate by correcting the intake air flow rate with the pulsation correction coefficient.

2. The engine controller according to claim 1, wherein the engine controller is configured to calculate the intake air flow rate by executing:

an instantaneous flow rate calculation process that calculates an air flow meter instantaneous flow rate as a value in a constant state in which the intake air flow rate is kept constant, the air flow meter instantaneous flow rate being an instantaneous value of the intake air flow rate calculated from the output of the air flow meter;

a smoothing process that calculates, as a value of a pre-pulsation correction air flow meter average flow rate, a value obtained by smoothing the air flow meter instantaneous flow rate; and a pulsation correction process that calculates, as a calculated value of the intake air flow rate, a value obtained by correcting the pre-pulsation correction air flow meter average flow rate with the pulsation correction coefficient.

3. The engine controller according to claim 2, wherein the engine controller is configured to compute an intake air amount used for combustion in a cylinder and determine the fuel injection amount based on a computed value of the intake air amount by executing:

a first intake air amount computation process that computes the intake air amount based on the output of the air flow meter;

a second intake air amount computation process that computes the intake air amount based on one of the throttle opening degree and an intake pipe pressure without using the output of the air flow meter;

a pulsation determination process that determines whether an intake air pulsation is great by calculating, as a pulsation rate, a ratio of a fluctuation amplitude of the air flow meter instantaneous flow rate to the calculated value of the intake air flow rate obtained by the pulsation correction process and by determining that the intake air pulsation is great when the pulsation rate is a value greater than or equal to a preset great pulsation determination; and a computation method switching process that sets a first intake air amount as the computed value of the intake air amount when the pulsation determination process determines that the intake air pulsation is not great and sets a second intake air amount as the computed value of the intake air amount when the pulsation determination process determines that the intake air pulsation is great, the first intake air amount being the computed value of the intake air amount obtained by the first intake air amount computation process, the second intake air amount being the computed value of the intake air amount obtained by the second intake air amount computation process.

4. An engine controller that calculates an intake air flow rate from an output of an air flow meter provided in a section of an intake passage upstream of a throttle valve and determines a fuel injection amount based on a calculation result of the intake air flow rate, wherein the engine controller comprises circuitry that is configured to:

calculate a pulsation correction coefficient based on an engine rotation speed, a throttle opening degree, and an atmospheric pressure, the pulsation correction coefficient being used to compensate for an output error of the air flow meter; and calculate the intake air flow rate by correcting the intake air flow rate with the pulsation correction coefficient.

5. An engine control method for calculating an intake air flow rate from an output of an air flow meter provided in a section of an intake passage upstream of a throttle valve and determines a fuel injection amount based on a calculation result of the intake air flow rate, the method comprising:

calculating a pulsation correction coefficient based on an engine rotation speed, a throttle opening degree, and an atmospheric pressure, the pulsation correction coefficient being used to compensate for an output error of the air flow meter; and calculating the intake air flow rate by correcting the intake air flow rate with the pulsation correction coefficient.

* * * * *